US010551082B2

(12) United States Patent
Nakayama et al.

(10) Patent No.: US 10,551,082 B2
(45) Date of Patent: Feb. 4, 2020

(54) AIR-CONDITIONING DEVICE

(71) Applicant: DAIKIN INDUSTRIES, LTD., Osaka-shi, Osaka (JP)

(72) Inventors: Toshimichi Nakayama, Osaka (JP); Yoshiteru Nouchi, Osaka (JP); Kousuke Shiohama, Osaka (JP); Ryouta Suhara, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 16/073,240

(22) PCT Filed: Jan. 18, 2017

(86) PCT No.: PCT/JP2017/001495
§ 371 (c)(1),
(2) Date: Jul. 26, 2018

(87) PCT Pub. No.: WO2017/145584
PCT Pub. Date: Aug. 31, 2017

(65) Prior Publication Data

US 2019/0032980 A1 Jan. 31, 2019

(30) Foreign Application Priority Data

Feb. 22, 2016 (JP) ..... 2016-031432

(51) Int. Cl.
*F24F 11/38* (2018.01)
*F24F 11/49* (2018.01)
(Continued)

(52) U.S. Cl.
CPC ..... *F24F 11/38* (2018.01); *F24F 11/49* (2018.01); *F24F 11/89* (2018.01); *F25B 49/005* (2013.01);
(Continued)

(58) Field of Classification Search
CPC .. F24F 11/30; F24F 11/32; F24F 11/38; F24F 11/49; F24F 11/89; F24F 2110/12;
(Continued)

(56) References Cited

FOREIGN PATENT DOCUMENTS

JP 60-11042 A 1/1985
JP 9-196447 A 7/1997
(Continued)

OTHER PUBLICATIONS

English Machine Translation KR 201245023. Accessed May 2019.*
(Continued)

*Primary Examiner* — Jianying C Atkisson
*Assistant Examiner* — Tavia Sullens
(74) *Attorney, Agent, or Firm* — Birch, Stewart, Kolasch & Birch, LLP.

(57) ABSTRACT

An air-conditioning device includes: a suction air temperature sensor provided in an indoor unit; a wireless temperature sensor unit separate from the indoor unit; an abnormal condition determining section determining whether or not the wireless temperature sensor unit is in an abnormal condition; an index setting section setting a temperature index value; and a controller controlling operation of the air-conditioning device based on the set temperature index value. While the abnormal condition determining section determines that the wireless temperature sensor unit is in the abnormal condition, the index setting section determines a measurement value of the suction air temperature sensor to be the temperature index value.

4 Claims, 5 Drawing Sheets

(51) Int. Cl.

| | |
|---|---|
| ***F24F 11/89*** | (2018.01) |
| ***F25B 49/02*** | (2006.01) |
| ***F25B 49/00*** | (2006.01) |
| *F24F 110/12* | (2018.01) |

(52) U.S. Cl.
CPC ... *F24F 2110/12* (2018.01); *F25B 2313/0314* (2013.01); *F25B 2313/0315* (2013.01); *F25B 2700/2103* (2013.01); *F25B 2700/2104* (2013.01); *F25B 2700/2106* (2013.01)

(58) Field of Classification Search
CPC .... F25B 2700/2104; F25B 2700/21151; F25B 2313/02741; F25B 2313/0314; F25B 2313/0315; F25B 49/005
See application file for complete search history.

(56) References Cited

FOREIGN PATENT DOCUMENTS

| | | | | |
|---|---|---|---|---|
| JP | 10-318590 | A | 12/1998 | |
| JP | 2008-286460 | A | 11/2008 | |
| JP | 2011-99612 | A | 5/2011 | |
| JP | 2014-137161 | A | 7/2014 | |
| KR | 101245023 | B1 * | 3/2013 | ..... F24F 11/053 |

OTHER PUBLICATIONS

International Search Report issued in PCT/JP2017/001495 (PCT/ISA/210), dated Mar. 7, 2017.
Extended European Search Report dated Sep. 2, 2019 in corresponding European Application No. 17756026.5.

* cited by examiner

AIR-CONDITIONING DEVICE

TECHNICAL FIELD

The present invention relates to an air-conditioning device.

BACKGROUND ART

An air-conditioning device conditioning air in an indoor space has been known (see, for example, Patent Document 1). The air-conditioning device includes an outdoor unit and an indoor unit which are connected together through pipes. Operation of the air-conditioning device is controlled by a controller. Patent Document 2 discloses the provision of a suction air temperature sensor that is used to measure the temperature of air taken into the indoor unit.

CITATION LIST

Patent Document

Patent Document 1: Japanese Unexamined Patent Publication No. 2011-099612

Patent Document 2: Japanese Unexamined Patent Publication No. 2014-137161

SUMMARY OF THE INVENTION

Technical Problem

In addition to the suction air temperature sensor, an ambient temperature sensor that measures an ambient temperature may be provided at an optional location in an indoor space to obtain information on the air temperature at the optional location. In this case, in order to be able to be installed at an optional location, the ambient temperature sensor suitably forms a portable wireless temperature sensor unit together with a transmitter capable of transmitting a signal of the measured value by radio.

The controller controls operation of the air-conditioning device, based on measurement values of the suction air temperature sensor and the ambient temperature sensor, so that the indoor temperature approaches, for example, a predetermined target temperature. In this case, the wireless temperature sensor unit may be used while being installed near a person present in the room. In such a situation, the measurement value of the ambient temperature sensor is suitably used to control operation of the air-conditioning device to improve comfort.

However, the wireless temperature sensor unit is not always used in an appropriate manner. For example, if the wireless temperature sensor unit is installed near any other heater during a heating operation, the measurement value of the ambient temperature sensor is higher than the actual indoor temperature. Such a situation is an example of a condition where the wireless temperature sensor unit fails to function normally. This condition is hereinafter referred to as a condition where "the wireless temperature sensor unit is in an abnormal condition." If the measurement value of the ambient temperature sensor is used to control operation of the air-conditioning device while the wireless temperature sensor unit is in an abnormal condition, air in the entire indoor space may be prevented from being appropriately conditioned. For example, in the foregoing case, the measurement value of the ambient temperature sensor is higher than the temperature of the air in the entire indoor space.

This allows the air in the entire indoor space to be heated only to a temperature lower than a target temperature even if a heating operation is performed based on the measurement value. In addition, it is also assumed that the wireless temperature sensor unit may fail to transmit a signal of the measurement value of the ambient temperature sensor due to a dead battery. In this case, the air-conditioning device may be uncontrollable.

In view of the foregoing background, it is therefore an object of the present invention to allow air at an optional location in an indoor space to be conditioned, and to allow air in the entire indoor space to be appropriately conditioned.

Solution to the Problem

A first aspect of the present disclosure is directed to an air-conditioning device (10) conditioning air in an indoor space (500). The device includes: an indoor unit (12) drawing indoor air, adjusting a temperature of the indoor air drawn, and expelling the indoor air into the indoor space (500); a suction air temperature sensor (61) provided in the indoor unit (12) to measure the temperature of the indoor air drawn into the indoor unit (12); a wireless temperature sensor unit (13) separate from the indoor unit (12), the wireless temperature sensor unit (13) including an ambient temperature sensor (13*b*) and a transmitter (13*c*), the ambient temperature sensor (13*b*) measuring an ambient temperature, the transmitter (13*c*) transmitting a signal of a measurement value (Tm2) of the ambient temperature sensor (13*b*) by radio; a receiving section (63*a*) receiving the signal transmitted by the transmitter (13*c*); an abnormal condition determining section (63*b*) determining whether or not the wireless temperature sensor unit (13) is in an abnormal condition; an index setting section (63*c*) setting a temperature index value serving as an index of indoor temperature; and a controller (28, 66) controlling operation of the air-conditioning device (10) based on the temperature index value set by the index setting section (63*c*). While the abnormal condition determining section (63*b*) determines that the wireless temperature sensor unit (13) is in the abnormal condition, the index setting section (63*c*) determines a measurement value (Tm1) of the suction air temperature sensor (61) to be the temperature index value.

According to the first aspect, the wireless temperature sensor unit (13) is used to measure the air temperature at an optional location in the indoor space (500), and the measurement value (Tm2) is used to control operation of the air-conditioning device (10). This allows air at the optional location in the indoor space (500) to be conditioned. On the other hand, if the wireless temperature sensor unit (13) is in the abnormal condition, controlling the operation of the air-conditioning device (10) based on the measurement value (Tm2) of the ambient temperature sensor (13*b*) may prevent air in the entire indoor space (500) from being appropriately conditioned as described above. To address this problem, in the first aspect, if the wireless temperature sensor unit (13) is in the abnormal condition, the operation of the air-conditioning device (10) is controlled based on the measurement value (Tm1) of the suction air temperature sensor (61). This allows the air in the entire indoor space (500) to be appropriately conditioned even if the wireless temperature sensor unit (13) is in the abnormal condition.

The second aspect of the present disclosure is an embodiment of the first aspect. In the second aspect, while the abnormal condition determining section (63*b*) determines that the wireless temperature sensor unit (13) is not in the abnormal condition, the index setting section (63*c*) determines the measurement value (Tm2) of the ambient temperature sensor (13*b*) to be the temperature index value.

Here, the wireless temperature sensor unit (13) is highly likely to be arranged near a person in the room. That is why using the measurement value (Tm2) of the ambient temperature sensor (13*b*) to control the operation of the air-conditioning device (10) is highly likely to allow the person in the room to feel more comfortable than using the measurement value (Tm1) of the suction air temperature sensor (61). Thus, in the second aspect, if the wireless temperature sensor unit (13) is not in the abnormal condition, the measurement value (Tm2) of the ambient temperature sensor (13*b*) is used to control the operation of the air-conditioning device (10).

A third aspect of the present disclosure is an embodiment of the first or second aspect. In the third aspect, the abnormal condition determining section (63*b*) is configured to, if an absolute value of a difference between the measurement value (Tm1) of the suction air temperature sensor (61) and the measurement value (Tm2) of the ambient temperature sensor (13*b*) is greater than or equal to a predetermined temperature difference threshold (ΔTth), determine that the wireless temperature sensor unit (13) is in the abnormal condition.

According to the third aspect, the suction air temperature sensor (61) measures the temperature of air actually drawn by the indoor unit (12). That is why the measurement value (Tm1) of the suction air temperature sensor (61) is less likely to differ significantly from the actual room temperature. Meanwhile, the wireless temperature sensor unit (13) may be arranged near any other heater, in the sunshine near a window, or at any other similar location. In this case, the measurement value (Tm2) of the ambient temperature sensor (13*b*) differs significantly from the actual room temperature. Thus, if the measurement value (Tm1) of the suction air temperature sensor (61) is significantly different from the measurement value (Tm2) of the ambient temperature sensor (13*b*), a determination is made that the wireless temperature sensor unit (13) is in the abnormal condition, and the measurement value (Tm1) of the suction air temperature sensor (61) is thus used to control the operation of the air-conditioning device (10). This allows air in the entire indoor space (500) to be more appropriately conditioned.

A fourth aspect of the present disclosure is an embodiment of any one of the first to third aspects. In the fourth aspect, the abnormal condition determining section (63*b*) is configured to, if the measurement value (Tm1) of the suction air temperature sensor (61) is less than or equal to a predetermined first temperature threshold (Tth1) or greater than or equal to a predetermined second temperature threshold (Tth2) greater than the first temperature threshold (Tth1), determine that the wireless temperature sensor unit (13) is in the abnormal condition.

According to the fourth aspect, if the measurement value (Tm1) of the suction air temperature sensor (61) is excessively low or high, the abnormal condition determining section (63*b*) determines that the wireless temperature sensor unit (13) is in the abnormal condition. For example, if the wireless temperature sensor unit (13) is installed at a location having a temperature significantly different from the average air temperature in the entire indoor space (500), the measurement value (Tm2) of the ambient temperature sensor (13*b*) is significantly different from the average air temperature in the entire indoor space (500). If, in this state, air is conditioned based on the measurement value (Tm2) of the ambient temperature sensor (13*b*), the temperature of air in the entire indoor space (500) becomes excessively low or high. This results in that the measurement value (Tm1) of the suction air temperature sensor (61) becomes excessively low or high. In the fourth aspect, in such a case, a determination is made that the wireless temperature sensor unit (13) is in the abnormal condition, and the measurement value (Tm1) of the suction air temperature sensor (61) is thus used to control the operation of the air-conditioning device (10). This allows air in the entire indoor space (500) to be more appropriately conditioned.

If the temperature of air in the entire indoor space (500) is excessively low or high, controlling the operation of the air-conditioning device (10) based on the measurement value (Tm2) of the ambient temperature sensor (13*b*) of the wireless temperature sensor unit (13) in the abnormal condition may cause an excessive load to be applied to components of the air-conditioning device (10). For example, if the room temperature in the indoor space (500) is excessively high while the measurement value (Tm2) of the ambient temperature sensor (13*b*) is low, controlling the operation of the air-conditioning device (10) based on the measurement value (Tm2) causes an excessive load to be applied to the components of the air-conditioning device (10) in order to further increase the heating capacity of the air-conditioning device (10). Then, an excessive load continuously applied to the components of the air-conditioning device (10) may lead to a breakdown in the air-conditioning device (10). To address this problem, in the fourth aspect, if the air temperature in the entire indoor space (500) is excessively low or high, the measurement value (Tm1) of the suction air temperature sensor (61) is used to control the operation of the air-conditioning device (10). This prevents an excessive load from being applied to the components of the air-conditioning device (10), and thus prevents the air-conditioning device (10) from being broken.

A fifth aspect of the present disclosure is an embodiment of any one of the first to fourth aspects. In the fifth aspect, the abnormal condition determining section (63*b*) is configured to, if the receiving section (63*a*) has not received the signal from the wireless temperature sensor unit (13) yet, determine that the wireless temperature sensor unit (13) is in the abnormal condition.

According to the fifth aspect, if no signal from the wireless temperature sensor unit (13) is recognized, the measurement value (Tm1) of the suction air temperature sensor (61) is used to control the operation of the air-conditioning device (10). This allows air in the entire indoor space (500) to be more appropriately conditioned.

A sixth aspect of the present disclosure is an embodiment of any one of the first to fifth aspects. In the sixth aspect, the air-conditioning device further includes: a receiver unit (63) including the receiving section (63*a*), the abnormal condition determining section (63*b*), and the index setting section (63*c*), the receiver unit (63) being housed in the indoor unit (12).

According to the sixth aspect, the receiving section (63*a*), the abnormal condition determining section (63*b*), and the index setting section (63*c*) are provided in the same unit (i.e., the receiver unit (63)).

ADVANTAGES OF THE INVENTION

According to an aspect of the present disclosure, a wireless temperature sensor unit (13) is used to condition air at an optional location in an indoor space (500). Additionally, even if the wireless temperature sensor unit (13) is in an abnormal condition, air in the entire indoor space (500) can be appropriately conditioned.

According to the second aspect, a measurement value (Tm2) of an ambient temperature sensor (13*b*) of the wireless temperature sensor unit (13) that is highly likely to be arranged near a person in the room is used to control operation of an air-conditioning device (10). This can improve the comfort of the person in the room.

According to the third to fifth aspects, air in the entire indoor space (500) can be more appropriately conditioned. Moreover, according to the fourth aspect, the air-conditioning device (10) can be prevented from being broken.

DESCRIPTION OF EMBODIMENTS

Embodiments of the present invention will be described in detail with reference to the drawings. The embodiment described below is merely an exemplary one in nature, and is not intended to limit the scope, applications, or use of the invention.

Configuration of Air-conditioning Device

Figure 1:
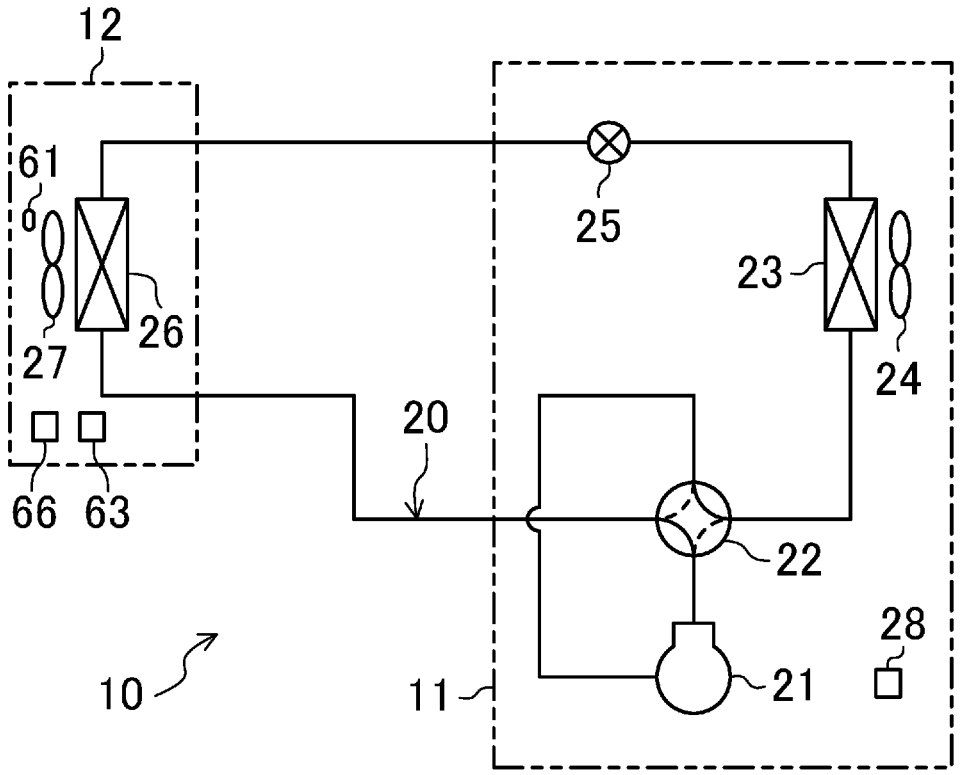
FIG. 1 is a refrigerant circuit diagram showing a general configuration of an air-conditioning device according to an embodiment.
Figure 2:
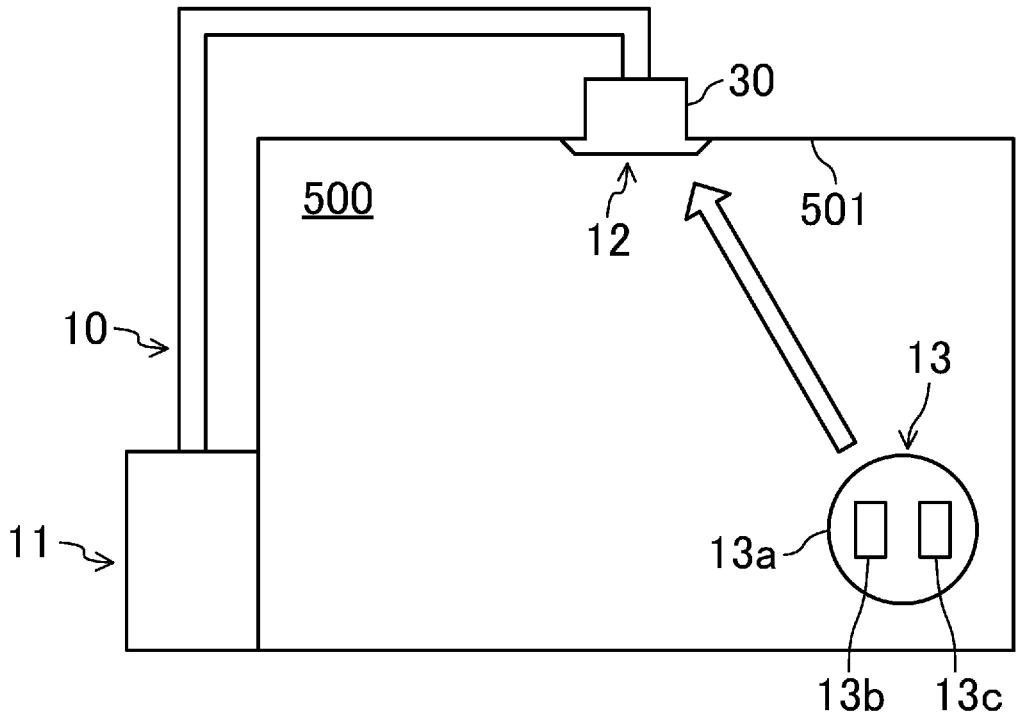
FIG. 2 schematically shows how the air-conditioning device of the embodiment is installed.

As shown in FIGS. 1 and 2, an air-conditioning device (10) of this embodiment includes an outdoor unit (11), an indoor unit (12), and a wireless temperature sensor unit (13). The outdoor unit (11) and the indoor unit (12) are connected together through pipes to form a refrigerant circuit (20), which performs a vapor compression refrigeration cycle.

The outdoor unit (11) includes a compressor (21), a four-way switching valve (22), an outdoor heat exchanger (23), an outdoor fan (24), an expansion valve (25), and an outdoor controller (28). The outdoor unit (11) is disposed outdoors as shown in FIG. 2. The air-conditioning device (10) is configured such that switching the four-way switching valve (22) allows the direction of flow of a refrigerant in the refrigerant circuit (20) to be changed reversibly.

The indoor unit (12) includes an indoor heat exchanger (26) and an indoor fan (27). As shown in FIG. 2, the indoor unit (12) is embedded in an opening of an indoor ceiling. That is to say, the indoor unit (12) of this embodiment is configured as a so-called ceiling-embedded indoor unit. A configuration of the indoor unit (12) will be described below in detail. The compressor (21) and the indoor fan (27) constitute components.

The wireless temperature sensor unit (13) is separate from the indoor unit (12), and can be installed at an optional location in an indoor space (500) (e.g., near a person present in the indoor space (500)) as shown in FIG. 2. The wireless temperature sensor unit (13) includes a unit case (13*a*), an ambient temperature sensor (13*b*), and a transmitter (13*c*). The ambient temperature sensor (13*b*) is disposed in the unit case (13*a*) to measure an ambient temperature. The transmitter (13*c*) is disposed in the unit case (13*a*) to transmit, by radio, a signal of a measurement value (Tm2) of the ambient temperature sensor (13*b*) to a receiver unit (63) described below.

The transmitter (13*c*) of the wireless temperature sensor unit (13) generates a signal including at least the measurement value (Tm2) of the ambient temperature sensor (13*b*), and transmits the generated signal by radio. The transmitter (13*c*) is configured to communicate with the receiver unit (63) once every predetermined time period (e.g., once every 10 seconds). The transmitter (13*c*) is configured so as to be prevented from transmitting the signal of the measurement value (Tm2) of the ambient temperature sensor (13*b*) to the receiver unit (63) if the difference between the temperature transmitted last time and the currently detected temperature is small (e.g., if the difference is 0.05° C. or less). The wireless temperature sensor unit (13) is configured to, when the remaining power of a built-in battery decreases to a low level, stop the transmission of the measurement value (Tm2) of the ambient temperature sensor (13*b*) and allow a built-in LED (not shown) to blink.

Configuration of Indoor Unit

Figure 3:
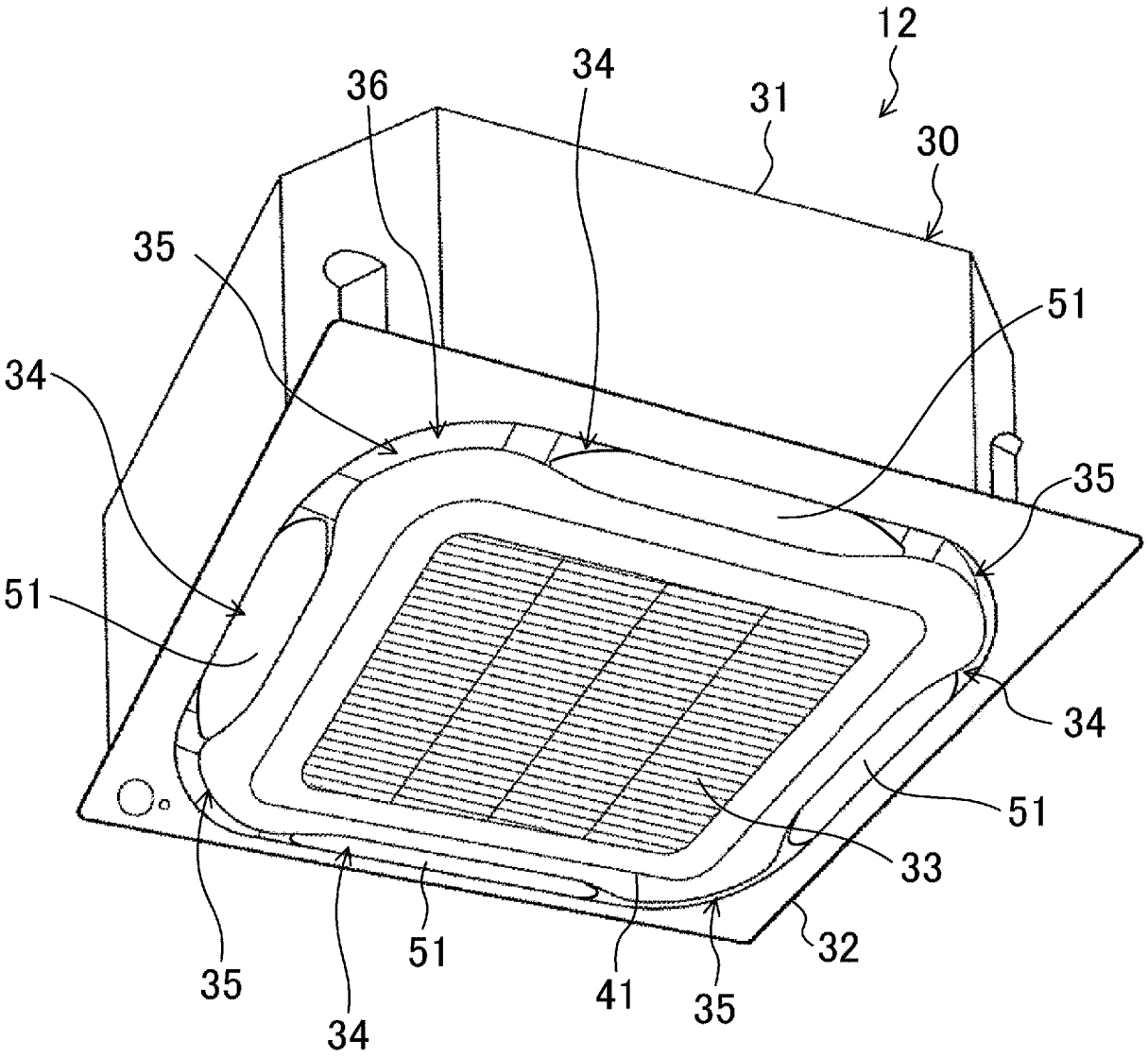
FIG. 3 is a perspective view of an indoor unit viewed obliquely from below.

As shown in FIGS. 1 to 3, the indoor unit (12) includes a casing (30). The casing (30) is provided on a ceiling (501) of the indoor space (500). The casing (30) is comprised of a casing body (31) and a decorative panel (32). The casing (30) houses the indoor fan (27) and the indoor heat exchanger (26). The casing (30) further houses a suction air temperature sensor (61), the receiver unit (63), and an indoor controller (66).

The casing body (31) is mounted by being inserted in an opening in the ceiling (501) of the indoor space (500). The casing body (31) has a generally rectangular parallelepiped box-like shape with its lower end open.

The indoor fan (27) is a centrifugal blower which draws air from below and expels the air radially outward. The indoor fan (27) is arranged at the center in the casing body (31).

The indoor heat exchanger (26) is a so-called cross-fin-type fin-and-tube heat exchanger. The air expelled by the indoor fan (27) passes through the indoor heat exchanger (26). The indoor heat exchanger (26) allows the air passing through the indoor heat exchanger (26) to exchange heat with the refrigerant in the refrigerant circuit.

The decorative panel (32) is a resinous member formed into a thick rectangular plate-like shape. A lower portion of the decorative panel (32) is in a square shape slightly larger than the casing body (31). The decorative panel (32) is arranged to cover the lower end of the casing body (31). The lower surface of the decorative panel (32) serves as a lower surface of the casing (30) and is exposed to the indoor space (500).

As illustrated in FIG. 3, the decorative panel (32) includes a central section having a square inlet opening (33). The inlet opening (33) passes through the decorative panel (32) in the vertical direction and communicates with the interior of the casing (30). The inlet opening (33) is provided with a grid-like intake grille (41).

The decorative panel (32) includes a generally rectangular annular air outlet (36) surrounding the inlet opening (33). As illustrated in FIG. 3, the air outlet (36) is divided into four main outlet openings (34) and four auxiliary outlet openings (35).

The main outlet openings (34) are narrow openings disposed along the four sides of the decorative panel (32). Each side of the decorative panel (32) is provided with one main outlet opening. Each of the auxiliary outlet openings (35) is in the shape of a quarter of a circle. The auxiliary outlet openings (35) are disposed at the four corners of the decorative panel (32). Each corner of the decorative panel (32) is provided with one auxiliary outlet opening.

As illustrated in FIG. 3, each main outlet opening (34) is provided with an airflow direction adjusting flap (51). The airflow direction adjusting flap (51) is a member for adjusting the direction of supply airflow (i.e., the direction of flow of the conditioned air coming from the main outlet openings (34)). The airflow direction adjusting flap (51) changes the direction of supply airflow upward and downward. That is, the airflow direction adjusting flap (51) changes the direction of supply airflow such that the angle between the direction of supply airflow and the horizontal direction changes.

Suction Air Temperature Sensor

Figure 4:
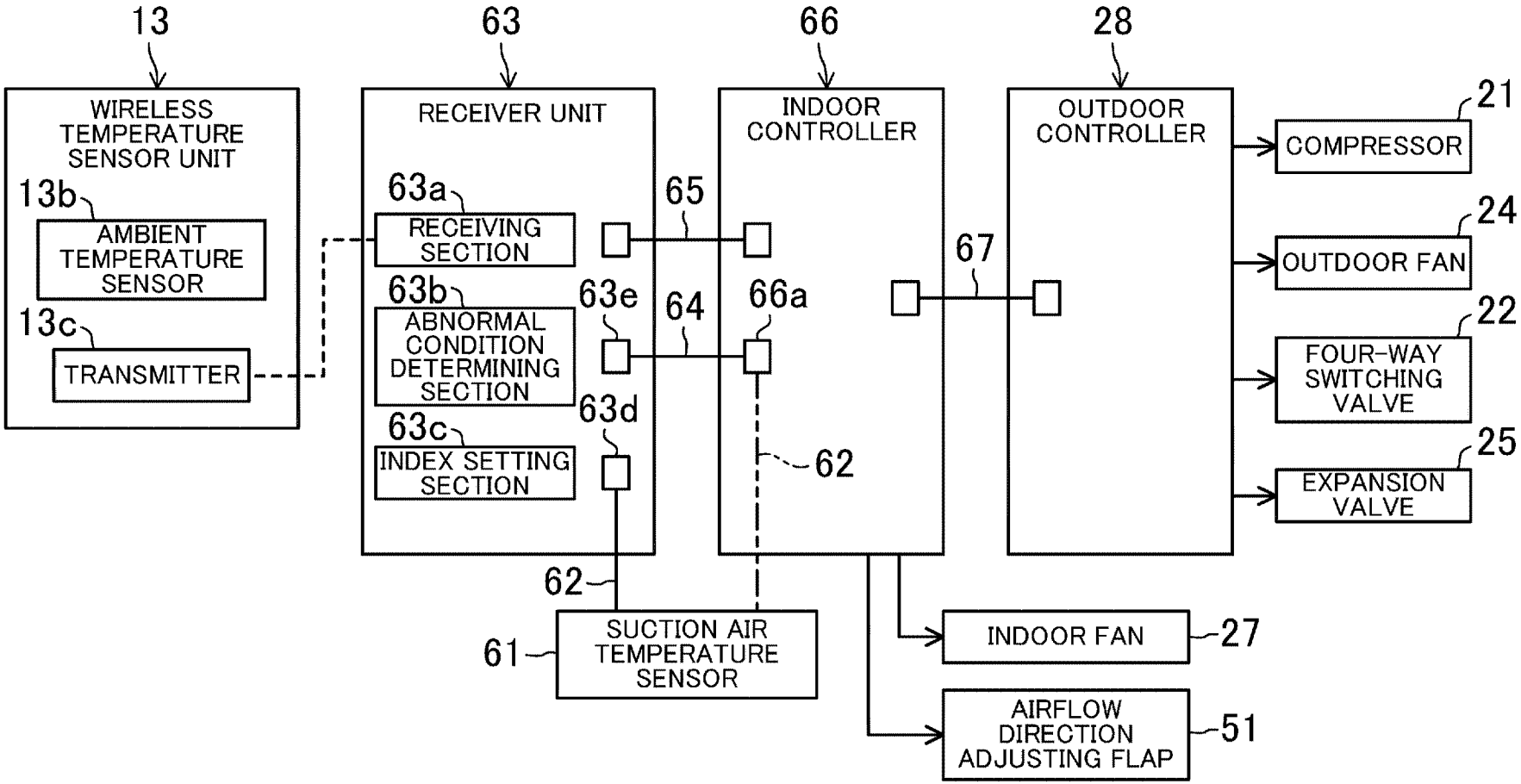
FIG. 4 schematically shows configurations of components of the air-conditioning device.

The suction air temperature sensor (61) is configured to measure the temperature of indoor air drawn into the casing (30) through the inlet opening (33). The suction air temperature sensor (61) is connected to an input connector (63*d*) of the receiver unit (63) through a sensor signal line (62) as shown in FIG. 4. The input connector (63*d*) is configured as, for example, a general-purpose connector.

Receiver Unit

As shown in FIG. 4, the receiver unit (63) includes the input connector (63*d*), which is connected to the sensor signal line (62) extending from the suction air temperature sensor (61) as described above. The receiver unit (63) is configured to receive a signal of a measurement value (Tm1) of the suction air temperature sensor (61) from the suction air temperature sensor (61) by wire.

As shown in FIG. 4, the receiver unit (63) includes a receiving section (63*a*), an abnormal condition determining section (63*b*), and an index setting section (63*c*). The receiver unit (63) is configured to transmit a signal of a temperature index value set by the index setting section (63*c*) to the indoor controller (66).

As shown in FIG. 4, the receiver unit (63) includes an output connector (63*e*), which is connected to one end of a control signal line (64). The other end of the control signal line (64) is connected to a common input connector (66*a*) of the indoor controller (66).

The receiver unit (63) is connected to the indoor controller (66) through a power line (65), and is further configured to receive power from the indoor controller (66) through the power line (65).

Note that the receiver unit (63) includes a plurality of LEDs (not shown). The receiver unit (63) is configured to change the mode in which the LEDs blink between a case where the wireless temperature sensor unit (13) is broken and a case where the receiver unit (63) is broken. The receiver unit (63) is configured to, if the wireless temperature sensor unit (13) is broken, change the mode in which the LEDs blink in accordance with which of the battery and body of the wireless temperature sensor unit (13) needs to be replaced. The receiver unit (63) is further configured to, if the receiver unit (63) is broken, change the mode in which the LEDs blink in accordance with the type of a component that needs to be replaced.

Receiving Section

The receiving section (63*a*) is configured to receive a signal of the measurement value (Tm2) of the ambient temperature sensor (13*b*). This signal is transmitted from the wireless temperature sensor unit (13) by radio. The receiving section (63*a*) transfers the received signal of the measurement value (Tm2) of the ambient temperature sensor (13*b*) to the abnormal condition determining section (63*b*).

Abnormal Condition Determining Section

The abnormal condition determining section (63*b*) is configured to determine whether or not the wireless temperature sensor unit (13) is in an abnormal condition, based on the measurement value (Tm1) of the suction air temperature sensor (61) and the measurement value (Tm2) of the ambient temperature sensor (13*b*).

Figure 5:
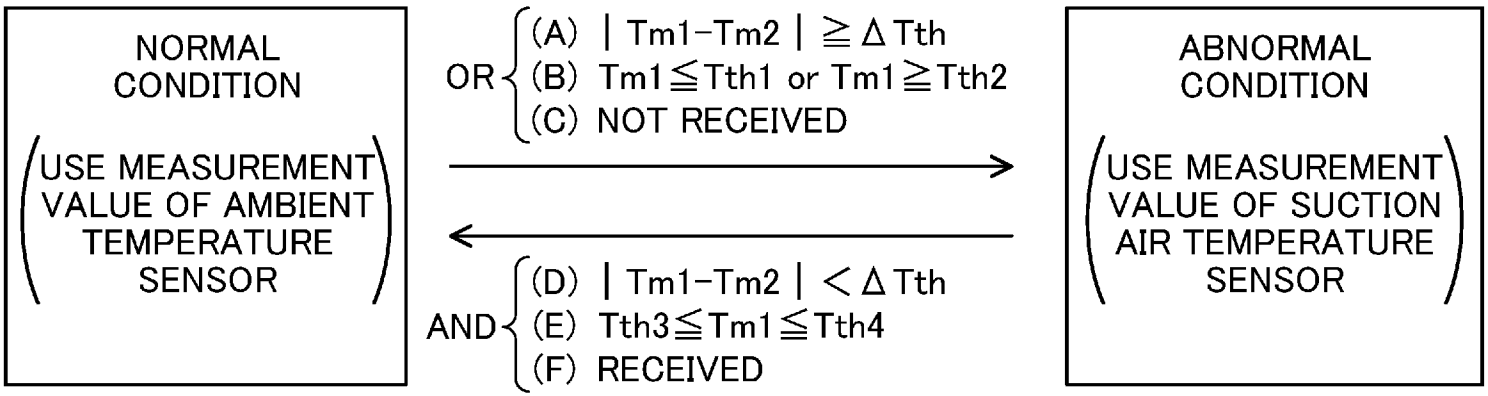
FIG. 5 is a state transition diagram showing how an abnormal condition determining section determines a condition of a wireless temperature sensor unit.

Specifically, as shown in FIG. 5, if at least one of the following three conditions (A) to (C) is satisfied while the wireless temperature sensor unit (13) is in a normal condition, the abnormal condition determining section (63*b*) determines that the wireless temperature sensor unit (13) is in an abnormal condition. Specifically, the condition (A) indicates a condition where the absolute value of the difference between the measurement value (Tm1) of the suction air temperature sensor (61) and the measurement value (Tm2) of the ambient temperature sensor (13*b*) is greater than or equal to a predetermined temperature difference threshold (ΔTth). The condition (B) indicates a condition where the measurement value (Tm1) of the suction air temperature sensor (61) is less than or equal to a predetermined first temperature threshold (Tth1) or greater than or equal to a predetermined second temperature threshold (Tth2). However, the second temperature threshold (Tth2) is greater than the first temperature threshold (Tth1) (Tth1<Tth2). The condition (C) indicates a condition where the receiver unit (63) has received no signal from the wireless temperature sensor unit (13). On the other hand, if none of the conditions (A) to (C) is satisfied, the abnormal condition determining section (63*b*) determines that the wireless temperature sensor unit (13) is in a normal condition.

In this case, when the condition (A) is satisfied, a determination can be made that the wireless temperature sensor unit (13) is in an abnormal condition for the following reason. Specifically, the suction air temperature sensor (61) measures the temperature of air actually drawn into the casing (30) of the indoor unit (12). That is why the measurement value (Tm1) of the suction air temperature sensor (61) is less likely to differ significantly from the actual room temperature. Meanwhile, the wireless temperature sensor unit (13) may be arranged near any other heater, in the sunshine near a window, or at any other similar location. In this case, the measurement value (Tm2) of the ambient temperature sensor (13*b*) differs significantly from the actual room temperature. Thus, if the measurement value (Tm1) of the suction air temperature sensor (61) differs significantly from the measurement value (Tm2) of the ambient temperature sensor (13*b*), a determination can be made that the wireless temperature sensor unit (13) is in an abnormal condition.

If the condition (B) is satisfied, a determination can be made that the wireless temperature sensor unit (13) is in an abnormal condition for the following reason. Specifically, for example, if the wireless temperature sensor unit (13) is installed at a location having a temperature significantly different from the room temperature in the entire indoor space (500), the measurement value (Tm2) of the ambient temperature sensor (13*b*) is significantly different from the room temperature in the entire indoor space (500). If, in this state, air is conditioned based on the measurement value of the ambient temperature sensor (13*b*), the temperature of air in the entire indoor space (500) becomes excessively low or high. This results in that the measurement value (Tm1) of the suction air temperature sensor (61) becomes excessively low or high. Thus, if the measurement value (Tm1) of the suction air temperature sensor (61) is excessively low or high, a determination can be made that the wireless temperature sensor unit (13) is in an abnormal condition.

If the condition (C) is satisfied, a determination can be made that the wireless temperature sensor unit (13) is in an abnormal condition for the following reason. Specifically, for example, if the wireless temperature sensor unit (13) cannot transmit a signal due to a power shortage, the receiver unit (63) cannot receive a signal from the wireless temperature sensor unit (13). In addition, moving the wireless temperature sensor unit (13) out of the room by mistake, for example, may prevent a signal from the wireless temperature sensor unit (13) from reaching the receiver unit (63). For these reasons, if the receiver unit (63) has received no signal from the wireless temperature sensor unit (13), a determination can be made that the wireless temperature sensor unit (13) is in an abnormal condition.

As shown in FIG. 5, if all of the following three conditions (D) to (F) are satisfied while the wireless temperature sensor unit (13) is in an abnormal condition, the abnormal condition determining section (63*b*) determines that the wireless temperature sensor unit (13) is in a normal condition. Specifically, the condition (D) indicates a condition where the absolute value of the difference between the measurement value (Tm1) of the suction air temperature sensor (61) and the measurement value (Tm2) of the ambient temperature sensor (13*b*) is less than the predetermined temperature difference threshold (ΔTth). The condition (E) indicates a condition where the measurement value (Tm1) of the suction air temperature sensor (61) is greater than or equal to a predetermined third temperature threshold (Tth3) and less than or equal to a predetermined fourth temperature threshold (Tth4). However, the third temperature threshold (Tth3) is slightly greater than the first temperature threshold (Tth1) and less than the second temperature threshold (Tth2). The fourth temperature threshold (Tth4) is slightly less than the second temperature threshold (Tth2) and greater than the third temperature threshold (Tth1<Tth3«Tth4<Tth2). The condition (F) indicates a condition where the receiver unit (63) has received a signal from the wireless temperature sensor unit (13). On the other hand, if at least one of the conditions (D) to (F) is not satisfied, the abnormal condition determining section (63*b*) determines that the wireless temperature sensor unit (13) is still in an abnormal condition.

Index Setting Section

The index setting section (63*c*) is configured to generate a signal serving as an index of indoor temperature, based on the measurement value (Tm2) of the ambient temperature sensor (13*b*) and the measurement value (Tm1) of the suction air temperature sensor (61). The index setting section (63*c*) determines either the measurement value (Tm1) of the suction air temperature sensor (61) or the measurement value (Tm2) of the ambient temperature sensor (13*b*) to be a temperature index value, based on the result determined by the abnormal condition determining section (63*b*). Specifically, while the abnormal condition determining section (63*b*) determines that the wireless temperature sensor unit (13) is in an abnormal condition, the index setting section (63*c*) determines the measurement value (Tm1) of the suction air temperature sensor (61) to be the temperature index value. On the other hand, while the abnormal condition determining section (63*b*) determines that the wireless temperature sensor unit (13) is not in an abnormal condition, the index setting section (63*c*) determines the measurement value (Tm2) of the ambient temperature sensor (13*b*) to be the temperature index value. Note that even while the abnormal condition determining section (63*b*) determines that the wireless temperature sensor unit (13) is not in an abnormal condition, the index setting section (63*c*) may determine the measurement value (Tm1) of the suction air temperature sensor (61) to be the temperature index value in some cases.

Indoor Controller

The indoor controller (66) is separate from the receiver unit (63). The indoor controller (66) controls the rotational speed of the indoor fan (27), the orientations of the airflow direction adjusting flaps (51), and other elements, based on the measurement value (Tm1) of the suction air temperature sensor (61) or the measurement value (Tm2) of the ambient temperature sensor (13*b*) which has been transmitted from the receiver unit (63).

The indoor controller (66) includes the common input connector (66*a*) having the same shape as the input connector (63*d*). The common input connector (66*a*) is selectively connectable to the control signal line (64) and the sensor signal line (62). The common input connector (66*a*) is configured as, for example, a connector identical to the connector constituting the input connector (63*d*). If none of the wireless temperature sensor unit (13) and the receiver unit (63) is provided, the sensor signal line (62) of the suction air temperature sensor (61) is connected to the common input connector (66*a*) as indicated by the chain double-dashed line shown in FIG. 4. In this state, the signal of the measurement value (Tm1) of the suction air temperature sensor (61) is directly fed to the indoor controller (66).

As shown in FIG. 4, the indoor controller (66) is connected to the outdoor controller (28) through a connection signal line (67). The indoor controller (66) is configured to transmit, to the outdoor controller (28), a signal of the temperature index value transmitted from the receiver unit (63).

The outdoor controller (28) controls the rotational speed of the compressor (21) based on the signal of the temperature index value received from the indoor controller (66), and performs other suitable operations. For example, during a cooling operation, if the temperature index value is higher than a target temperature, the outdoor controller (28) increases the rotational speed of the compressor (21), whereas if the temperature index value is lower than the target temperature, the outdoor controller (28) reduces the rotational speed of the compressor (21). For example, during a heating operation, if the temperature index value is lower than a target temperature, the outdoor controller (28) increases the rotational speed of the compressor (21), whereas if the temperature index value is higher than the target temperature, the outdoor controller (28) reduces the rotational speed of the compressor (21).

The indoor controller (66) may be integrated with the receiver unit (63). The indoor controller (66) and the outdoor controller (28) constitute a controller.

Operation

How the air-conditioning device (10) operates will now be described below. If a heating operation or a cooling operation is to be performed, the compressor (21), the outdoor fan (24), and the indoor fan (27) are driven. In this manner, the refrigerant circuit (20) allows a refrigerant to circulate therethrough to perform a vapor compression refrigeration cycle. Thus, the cooling operation, the heating operation, or any other operation is performed. In this case, during the cooling operation, switching the four-way switching valve (22) allows the outdoor heat exchanger (23) to function as a radiator (condenser), and allows the indoor heat exchanger (26) to function as an evaporator. On the other hand, during the heating operation, switching the four-way switching valve (22) allows the indoor heat exchanger (26) to function as a radiator (condenser), and allows the outdoor heat exchanger (23) to function as an evaporator.

Here, during operation of the indoor unit (12), rotation of the indoor fan (27) allows air in the indoor space (500) to flow through the inlet opening (33) into the casing (30). The air that has flowed into the casing (30) is drawn into the indoor fan (27), and expelled into the indoor heat exchanger (26). The air expelled through the indoor fan (27) is cooled or heated while passing through the indoor heat exchanger (26), and is expelled through the four main outlet openings (34) and the four auxiliary outlet opening (35) into the indoor space (500).

In the indoor unit (12) performing a cooling operation, the indoor heat exchanger (26) functions as an evaporator to cool the air passing through the indoor heat exchanger (26). On the other hand, in the indoor unit (12) performing a heating operation, the indoor heat exchanger (26) functions as a condenser to heat the air passing through the indoor heat exchanger (26).

The indoor unit (12) is configured to expel conditioned air into the indoor space (500) such that the temperature of air in the indoor space (500) is equal to a predetermined target temperature. Here, the indoor controller (66) controls components of the indoor unit (12) based on the temperature index value set by the index setting section (63*c*). For example, the indoor controller (66) controls the rotational speed of the indoor fan (27) to control the flow rate of conditioned air expelled into the indoor space (500). The indoor controller (66) individually controls the positions of the four airflow direction adjusting flaps (51) to control the direction in which the conditioned air is expelled.

The outdoor controller (28) controls components of the outdoor unit (11) based on the temperature index value set by the index setting section (63*c*). The outdoor controller (28) controls, for example, the rotational speed of the compressor (21) to regulate the heating or cooling capacity of the air-conditioning device (10). The outdoor controller (28) further controls the rotational speed of the outdoor fan (24), switching of the four-way switching valve (22), the degree of opening of the expansion valve (25), and other elements.

During the heating operation, a downward blowing operation in which conditioned warm air is blown substantially downward, a horizontal blowing operation in which conditioned warm air is blown substantially horizontally, or any other operation is performed. On the other hand, during the cooling operation, a swinging operation in which conditioned air having a relatively low temperature is blown while the airflow direction adjusting flaps (51) are swung substantially between the horizontal direction and the downward direction, a horizontal blowing operation in which conditioned air having a relatively low temperature is blown substantially horizontally, or any other operation is performed.

Advantages of Embodiment

In the air-conditioning device (10) of this embodiment, if the wireless temperature sensor unit (13) that can be installed at an optional location in the indoor space (500) is not in an abnormal condition, the measurement value (Tm2) of the ambient temperature sensor (13*b*) of the wireless temperature sensor unit (13) is used to control operation of the air-conditioning device (10). This allows air at the optional location in the indoor space (500) to be conditioned. On the other hand, if the wireless temperature sensor unit (13) is in an abnormal condition, not the measurement value (Tm2) of the ambient temperature sensor (13*b*) but the measurement value (Tm1) of the suction air temperature sensor (61) of the indoor unit (12) is used to control the operation of the air-conditioning device (10). This allows air in the entire indoor space (500) to be appropriately conditioned even if the wireless temperature sensor unit (13) is in the abnormal condition.

If the wireless temperature sensor unit (13) is not in an abnormal condition, the measurement value (Tm2) of the ambient temperature sensor (13*b*) of the wireless temperature sensor unit (13) that is highly likely to be arranged near a person in the room is used to control the operation of the air-conditioning device (10). This can improve the comfort of the person in the room.

If the measurement value (Tm1) of the suction air temperature sensor (61) is significantly different from the measurement value (Tm2) of the ambient temperature sensor (13*b*), a determination is made that the wireless temperature sensor unit (13) is in an abnormal condition, and the measurement value (Tm1) of the suction air temperature sensor (61) is thus used to control the operation of the air-conditioning device (10). This allows air in the entire indoor space (500) to be more appropriately conditioned.

If the measurement value (Tm1) of the suction air temperature sensor (61) is excessively low or high, a determination is made that the wireless temperature sensor unit (13) is in an abnormal condition, and the measurement value (Tm1) of the suction air temperature sensor (61) is thus used to control the operation of the air-conditioning device (10). This allows air in the entire indoor space (500) to be more appropriately conditioned, and can prevent the air-conditioning device (10) from being broken.

On the other hand, if the receiving section (63*a*) has not received a signal from the wireless temperature sensor unit (13) yet, a determination is made that the wireless temperature sensor unit (13) is in an abnormal condition, and the measurement value (Tm1) of the suction air temperature sensor (61) is thus used to control the operation of the air-conditioning device (10). This allows air in the entire indoor space (500) to be more appropriately conditioned.

Variation of Embodiment

A variation of the embodiment will now be described. In this variation, a receiving section (63*a*) and other suitable components are provided for not a receiver unit (63) but a remote control unit for an air-conditioning device (10).

Specifically, in some cases, the air-conditioning device (10) includes a remote control unit (not shown) connected to an indoor unit (12) through a lead. In such a case, the receiving section (63*a*) may be provided for the remote control unit. In addition to the receiving section (63*a*), either or both of an abnormal condition determining section (63*b*) and an index setting section (63*c*) may be provided for the remote control unit.

Other Embodiments

In the foregoing embodiment, the abnormal condition determining section (63*b*) and the index setting section (63*c*) are provided for the receiver unit (63). However, the abnormal condition determining section (63*b*) and the index setting section (63*c*) may be provided for, for example, the indoor controller (66). In this case, the measurement value (Tm1) of the suction air temperature sensor (61) may be transferred through the receiver unit (63) to the indoor controller (66), or may be directly fed to the indoor controller (66).

The receiving section (63*a*) may be provided for the indoor controller (66). Additionally, the abnormal condition determining section (63*b*) and the index setting section (63*c*) may be provided for the indoor controller (66). In this case, a signal transmitted from the wireless temperature sensor unit (13) is received by the indoor controller (66).

In the foregoing embodiment, the air-conditioning device (10) includes only one indoor unit (12). However, the air-conditioning device (10) may include two or more indoor units (12).

In the foregoing embodiment, not only the main outlet openings (34) but also the auxiliary outlet openings (35) are provided. However, the auxiliary outlet openings (35) do not have to be provided.

In the foregoing embodiment, the indoor unit (12) is configured to expel conditioned air in four directions. However, the indoor unit (12) may be configured to expel conditioned air, for example, in one or two directions.

The indoor unit (12) may be not a ceiling-embedded indoor unit embedded in the opening of the ceiling (501), but a ceiling-hanging indoor unit having the casing (30) hung from the ceiling (501), a wall-mounted indoor unit, or a floor-mounted indoor unit.

INDUSTRIAL APPLICABILITY

As can be seen from the foregoing description, the present invention is useful for an air-conditioning device.

DESCRIPTION OF REFERENCE CHARACTERS

10 Air-Conditioning Device
12 Indoor Unit
13 Wireless Temperature Sensor Unit
13*b* Ambient Temperature Sensor
13*c* Transmitter
28 Outdoor Controller (Controller)
61 Suction Air Temperature Sensor
63 Receiver Unit
63*a* Receiving Section
63*b* Abnormal Condition Determining Section
63*c* Index Setting Section
66 Indoor Controller (Controller)
500 Indoor Space

The invention claimed is:

1. An air-conditioning device conditioning air in an indoor space, the device comprising:

an indoor unit drawing indoor air, adjusting a temperature of the indoor air drawn, and expelling the indoor air into the indoor space;

a suction air temperature sensor provided in the indoor unit to measure the temperature of the indoor air drawn into the indoor unit;

a wireless temperature sensor unit separate from the indoor unit, the wireless temperature sensor unit including an ambient temperature sensor and a transmitter, the ambient temperature sensor measuring an ambient temperature, the transmitter transmitting a signal of a measurement value of the ambient temperature sensor by radio;

a receiver configured to receive the signal transmitted by the transmitter;

determine whether or not the wireless temperature sensor unit is in an abnormal condition based on whether one or more predefined abnormal operation conditions have been satisfied, one of the abnormal operation conditions to be satisfied being a measurement value of the suction air temperature sensor being less than or equal to a predetermined first temperature threshold or greater than or equal to a predetermined second temperature threshold, the second temperature threshold being greater than the first temperature threshold;

set a temperature index value serving as an index of indoor temperature such that when the wireless temperature sensor unit is determined to be in an abnormal condition the temperature index value is set to the measurement value of the suction air temperature sensor and otherwise the temperature index value is set to the measurement value of the ambient temperature sensor; and a controller configured to control operation of the air-conditioning device based on the temperature index value set by the receiver.

2. The air-conditioning device of claim 1, wherein the one or more predefined abnormal operation conditions including the receiver has not received the signal from the wireless temperature sensor unit.

3. The air-conditioning device of claim 1, wherein the one or more predefined abnormal operation conditions including an absolute value of a difference between the measurement value of the suction air temperature sensor and the measurement value of the ambient temperature sensor being greater than or equal to a predetermined temperature difference threshold.

4. The air-conditioning device of claim 3, wherein the one or more predefined abnormal operation conditions including the receiver has not received the signal from the wireless temperature sensor unit.

* * * * *